United States Patent [19]

Simmons

[11] 4,058,030

[45] Nov. 15, 1977

[54] WATER FAUCET TOOL MEANS

[76] Inventor: Willis H. Simmons, 9766 Redwood Road, Millington, Tenn. 38053

[21] Appl. No.: 666,179

[22] Filed: Mar. 11, 1976

[51] Int. Cl.[2] ..... B25B 27/24; B25B 13/48

[52] U.S. Cl. ..... 81/53 R; 81/55; 81/57.32

[58] Field of Search ..... 81/13, 55, 53 R, 57.32, 81/3 F, 3 R, 121 R

[56] References Cited

U.S. PATENT DOCUMENTS

| | | | |
|---|---|---|---|
| 439,388 | 10/1890 | Cushman | 81/121 R |
| 2,602,356 | 8/1952 | Wanamaker | 81/13 |
| 3,156,141 | 11/1964 | Pluntz | 81/57.32 |

*Primary Examiner*—James L. Jones, Jr.
*Assistant Examiner*—Roscoe V. Parker

[57] ABSTRACT

A device for use with a water faucet of the type having at least one nut mounted on the water inlet pipes thereof beneath a water basin for holding the water faucet to the water basin. The device includes a wrench member for closely fitting around the nut holding the water faucet to the water basin and includes a securing member for securing the wrench member to the nut so that the nut can be easily removed from the water inlet pipe of the water faucet.

10 Claims, 6 Drawing Figures

WATER FAUCET TOOL MEANS

BACKGROUND OF THE INVENTION

1. Field of the Invention

This invention relates generally to tool means for use with water faucets and more specifically to such tool means for use in removing the nuts mounted on the water inlet pipes of a water faucet beneath a water basin that hold the water faucet to the water basin.

2. Description of the Prior Art

Heretofore, various tool means have been developed for use in removing the nuts mounted on the water inlet pipes of a water faucet beneath a water basin that hold the water faucet to the water basin. The problems encountered in trying to remove such nuts occur for a number of reasons such as the location of the nuts (beneath and behind the water basin), the thinness of the nuts, and the fact that the nuts are usually corroded by the time they are to be removed. The tool most frequently used to remove such nuts consists of an elongated handle member having a transverse nut engaging portion at one end thereof. The nut engaging portion consists of a hinged clamp member which serves to wedge the nut to be removed between a portion of the elongated handle member and itself so that when the elongated handle member is turned the nut will be caused to likewise turn. This tool has not proved entirely satisfactory since to remove one of the nuts mounted on the water inlet pipes of a water faucet beneath a water basin with this tool, the user must lie on his back and try to balance a light in a manner so as to shine on the nut to be removed while using both hands to manipulate the tool so as to prevent the clamp member from slipping off the nut.

SUMMARY OF THE INVENTION

The present invention is directed towards overcoming the problems and disadvantages of prior tool means for use in removing the nuts mounted on the water inlet pipes of a water faucet beneath a water basin that hold the water faucet to the water basin. The concept of the present invention is to provide a tool means which may be secured to one of the nuts holding a water faucet to a water basin in a manner so that the nuts may be easily removed.

The tool means of the present invention includes a wrench means for closely fitting around one of the nuts holding the water faucet to the water basin and includes a securing means for securing the wrench means to one of the nuts holding the water faucet to the water basin. The wrench means includes a body member having a first end and a second end and having a longitudinal aperture completely therethrough. The portion of the longitudinal aperture adjacent the first end has a cross-sectional shape substantially identical to the cross-sectional shape of one of the nuts holding the water faucet to the water basin. The securing means includes a rod member for extending through the longitudinal aperture of the body member of the wrench means and through one of the nuts holding the water faucet to the water basin. The rod member has a first end and a second end with at least the first end being threaded. The securing means also includes a plate member fixedly attached to the second end of the rod member. The plate member is of a shape so as to prevent the wrench means from passing thereover. In addition, the securing means includes a nut member having a threaded aperture therethrough for coacting with the threaded first end of the rod member in a manner to clamp the wrench means about one of the nuts holding the water faucet to the water basin and against the underneath side of the water basin.

DESCRIPTION OF THE PREFERRED EMBODIMENT

Figure 1:
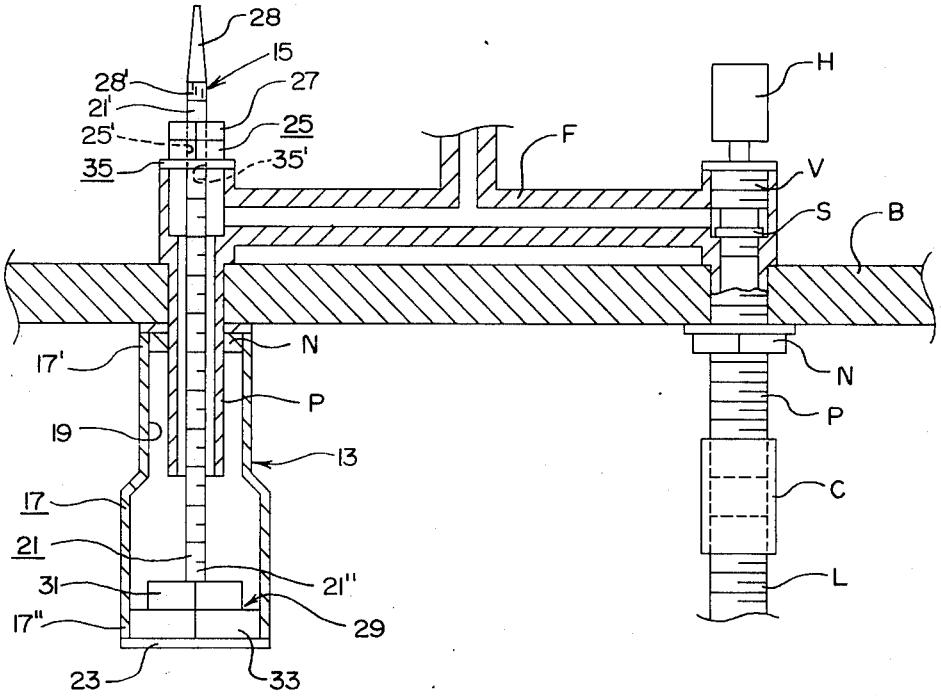
FIG. 1 is a partially sectional view of the tool means of the present invention shown secured to one of the nuts holding a water faucet to a water basin.
Figure 6:
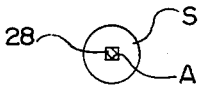
FIG. 6 is a sectional view of a portion of the tool means of the present invention as taken on line VI—VI of FIG. 5.

The tool means 11 of the present invention is for use with a water faucet F of substantially typical construction to remove the nuts N mounted on the water inlet pipes P of the water faucet F beneath a water basin B that hold the water faucet F to the water basin B (see FIG. 1). The water faucet F is of the type that typically includes at least one water inlet pipe P (two being shown in FIG. 1) for being coupled to a water line L by a standard coupling member C or the like, a valve member V having a valve handle H for allowing the flow of water through the water faucet F to be manually controlled, and a valve seat S for coacting with the valve member V in a manner well known to those skilled in the art. It should be noted that the valve seat S may be of the removable type well known to those skilled in the art and in which case it is provided with an aperture A having a square cross-sectional shape or the like (see FIG. 6) to allow it to be easily removed by way of a well known tool specifically adpated for such use. The tool means 11 includes wrench means 13 for closely fitting around one of the nuts N holding the water faucet F to the water basin B and includes securing means 15 for securing the wrench means 13 to one of the nuts N holding the water faucet F to the water basin B.

Figure 2:
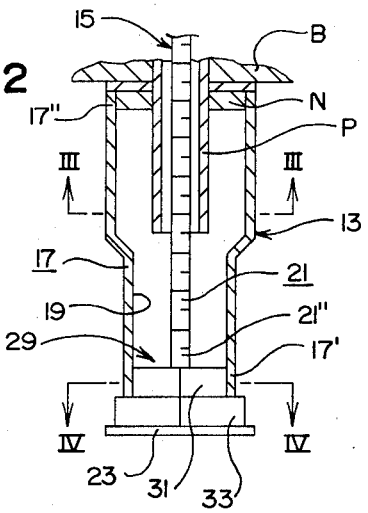
FIG. 2 is a partially sectional view of a portion of the tool means of the present invention shown secured to one of the nuts holding a water faucet to a water basin, the nut being of a different size than that shown in FIG. 1.
Figure 3:
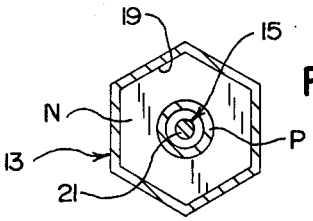
FIG. 3 is a sectional view of a portion of the tool means of the present invention as taken on line III—III of FIG. 2.
Figure 4:
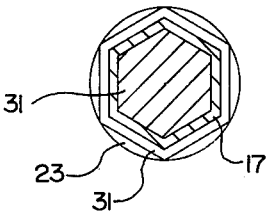
FIG. 4 is a sectional view of a portion of the tool means of the present invention as taken on line IV—IV of FIG. 2.

The wrench means 13 includes a body member 17 having a first end 17' and a second end 17'' and having a longitudinal aperture 19 completely therethrough. The portion of the longitudinal aperture 19 adjacent the first end 17' of the body member 17 has a cross-sectional shape substantially identical to the cross-sectional shape of a first standard size of the nuts N holding the water faucet F to the water basin B. More specifically, the portion of the longitudinal aperture 19 adjacent the first end 17' of the body member 17 preferably has a hexagonal cross-sectional shape that is substantially the same size as one of the standard sizes of nuts N commonly used to hold a water faucet F to a water basin B. In addition, the portion of the longitudinal aperture 19 adjacent the second end 17″ of the body member 17 may have a cross-sectional shape substantially identical to the cross-sectional shape of a second standard size of the nuts N holding the water faucet F to the water basin B. More sepcifically, the portion of the longitudinal aperture 19 adjacent the second end 17″ of the body member 17 may have a hexagonal cross-sectional shape substantially the same size as a second standard size of nuts N used to hold a water faucet F to a water basin B. This allows the wrench means 13 to be reversed from the position as shown in FIG. 1 to the position as shown in FIG. 2 for use on the two most common sizes of nuts N. It should be noted that the wrench means 13 is preferably constructed of metal and may consist of a commercially available double end socket member that is well known to those skilled in the art.

The securing means 15 includes a rod member 21 for extending through the longitudinal aperture 19 of the body member 17 of the wrench means 13 and through one of the nuts N holding the water faucet F to the water basin B. The rod member 21 has a first end 21′ and a second end 21″. At least the first end 21′ of the rod member 21 is threaded for a reason which will hereinafter become apparent. The securing means 15 also includes a plate member 23 fixedly attached to the second end 21″ of the rod member 21. The plate member 23 is of a shape so as to prevent the wrench means 13 from passing thereover. More specifically, the plate member 23 preferably has a cross-sectional shape larger than the cross-sectional shape of the longitudinal aperture 19 of the body member 17 of the wrench means 13 so that when the first end 21′ of the rod member 21 of the securing means 15 is inserted through the longitudinal aperture 19 of the body member 17 of the wrench means 13, the plate member 23 will act as a stop to prevent the second end 21″ of the rod member 21 of the securing means 15 from passing through the longitudinal aperture 19 of the body member 17 of the wrench means 13. In addition, the securing means 15 includes a nut member 25 having a threaded aperture 25′ therethrough for coacting with the threaded first end 21′ of the rod member 21 in a manner to clamp the wrench means 13 about one of the nuts N holding the water faucet F to the water basin B and against the underneath side of the water basin B. It should be noted that the securing means 15 may include a second nut member 27 substantially identical to the nut member 25 for acting as a lock nut when screwed against the nut member 25. Also, the first end 21′ of the rod member 21 of the securing means 15 may be provided with a tapered portion 28 for coacting with the aperture A in the valve seat S when the valve seat S is of the removable type. The tapered portion 28 may have a substantially square cross-sectional shape or the like (see FIG. 6) which corresponds with the cross-sectional shape of the aperture A in the valve seat S. The square cross-sectional shape of the tapered portion 28 may extend down the rod member 21 past the tapered portion 28 to provide a grip portion 28′ for reasons which will hereinafter become apparent.

The tool means 11 may include an alignment means 29 fixedly attached to the rod member 21 of the securing means 15 for coacting with the body member 17 of the wrench means 13 to centrally align the longitudinal aperture 19 of the body member 17 about the rod member 21 of the securing means 15. The alignment means 29 is preferably fixedly attached to the second end 21″ of the rod member 21. Conveniently, the alignment means 29 includes a first alignment member 31 having a cross-sectional shape substantially identical to the cross-sectional shape of the portion of the longitudinal aperture 19 of the body member 17 of the wrench means 13 adjacent the first end 17′ of the body member 17 for selectively coacting therewith (see FIG. 2) and includes a second alignment member 33 having a cross-sectional shape substantially identical to the cross-sectional shape of the portion of the longitudinal aperture 19 of the body member 17 of the wrench means 13 adjacent the second end 17″ of the body member 17 for selectively coacting therewith (see FIG. 1). It should also be noted that the first and second alignment members 31, 33 also act as means for transmitting torque between the securing means 15 and the wrench means 13 to cause the securing means 15 and wrench means 13 to rotate together. That is, when the first and second alignment members 31, 33 act as fixation members, the rotation of either the wrench means 13 or the securing means 15 will result in the rotation of the other.

Figure 5:
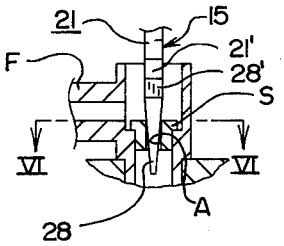
FIG. 5 is an elevational view of a portion of the tool means of the present invention shown removing a removable valve seat from a water faucet.

To use the tool means 11 of the present invention to remove one of the nuts N holding a water faucet F to a water basin B, the first step is to remove the valve V and valve handle H from the water faucet F in a manner well known to those skilled in the art. Next, if the water faucet F is one that is provided with a removable valve seat S, the valve seat S must be removed. This may be accomplished in a manner well known to those skilled in the art by using a tool specially adapted for removing such valve seats or by using the tapered portion 28 of the rod means 21 of the securing means 15 of the tool means 11 as shown in FIG. 5. Next, the rod member 21 of the securing means 15 is inserted through the longitudinal aperture 19 of the body member 17 of the wrench means 13 in a manner so that the portion of the longitudinal apertaure 19 that has a cross-sectional shape not substantially identical to the cross-sectional shape of the nut N to be removed is adjacent the second end 21″ of the rod member 21 and so that the portion of the longitudinal aperture 19 that has a cross-sectional shape substantially identical to the cross-sectional shape of the nut N to be removed is upwardly directed for being subsequently positioned around the nut N to be removed. The first end 21′ of the rod member 21 of the securing means 15 is then inserted from beneath the water basin B through the water inlet pipe P of the water faucet F onto which the nut N to be removed is mounted. Next, the nut member 25 is screwed on the first end 21′ of the rod member 21 of the securing means 15 causing the alignment means 29 to align the longitudinal aperture 19 of the body member 17 of the wrench means 13 about the rod member 21 of the securing means 15 and causing the upwardly directed portion of the longitudinal aperture 19 of the body member 17 of the wrench means 13 to closely fit around the nut N to be removed. A washer 35 is preferably provided between the nut member 25 and the water faucet F (see FIG. 1) so that the nut member 25 can be tightened against the washer 35 rather than directly against the water faucet F. The washer 35 is of typical construction as is well known to those skilled in the art and includes an aperture 35′ therethrough for allowing the rod member 21 to pass therethrough. It should be noted that when the nut member 25 is screwed onto the first end 21′ of the rod member 21 of the securing means 15, the plate member 23 will contact the end of the body member 17 that is adjacent the second end 21″ of the rod member 21 to pull the body member 17 of the wrench means 13 around the nut N to be removed. In addition, it should be noted that a flat portion of the second alignment member 33 of the alignment means 29 may act as the plate member 23 as shown in FIG. 2. Next, the wrench means 13 is manually turned in a direction to loosen the nut N to be removed. More specifically, the grip portion 28' of the rod member 21 of the securing means 15 is gripped with a typical wrench or the like and manually turned in a direction to loosen the nut N to be removed. When the rod member 21 is so turned, the first or second alignment member 31, 33 that is coacting with a portion of the longitudinal aperture 19 of the body member 17 of the wrench means 13 will act as a means for transmitting torque between the rod member 21 and the wrench means 13 to cause the wrench means 13 to rotate with the rod member 21. Finally, the manual turning of the body member 17 of the wrench means 13 is continued until the nut N is removed from the water inlet pipe P. Once the nut N is removed from the water inlet pipe P, the nut member 25 is completely removed from the rod member 21 of the securing means 15. It should be noted that the tool means 11 may be used to install a water faucet F on a water basin B by following the reverse of the above mentioned steps.

Although the invention has been described and illustrated with respect to a preferred embodiment thereof, it is not be be so limited since changes and modifications may be made therein which are within the full intended scope of the invention.

I claim:

1. Tool means for use on the nuts mounted beneath a water basin on the water inlet pipes of a water faucet that hold the water faucet to the water basin, said tool means comprising:

a. wrench means for closely fitting around one of said nuts holding the water faucet to the water basin, said wrench means including a body member having a first end and a second end and having a longitudinal aperture completely therethrough, the portion of said longitudinal aperture adjacent said first end of said body member having a cross-sectional shape substantially identical to the cross-sectional shape of a first standard size of said nuts holding the water faucet to the water basin;

b. securing means for securing said wrench means to one of said nuts holding the water faucet to the water basin, said securing means including a rod member for extending through said longitudinal aperture of said body member of said wrench means and through one of said nuts holding the water faucet to the water basin, said rod member having a first end and second end, at least said first end of said rod member being threaded, said securing means including a plate member fixedly attached to said second end of said rod member, said plate member being of a shape so as to prevent said wrench means from passing thereover, said securing means including a nut member having a threaded aperture therethrough for coacting with said threaded first end of said rod member in a manner to clamp said wrench means about one of said nuts holding the water faucet to the water basin and against the underneath side of the water basin; and c. means for transmitting torque between said rod member of said securing means and said wrench means.

2. The tool means of claim 1 in which the portion of said longitudinal aperture of said body member of said wrench means adjacent said second end of said body member has a cross-sectional shape substantially identical to the cross-sectional shape to a second standard size of said nuts holding the water faucet to the water basin.

3. The tool means of claim 2 in which said means for transmitting torque between said rod member of said securing means and said wrench means includes alignment means fixedly attached to said rod member of said securing means for coacting with said body member of said wrench means to centrally align said longitudinal aperture of said body member of said wrench means about said rod member of said securing means.

4. The tool means of claim 3 in which said alignment means includes a first alignment member having a cross-sectional shape substantially identical to the cross-sectional shape of the portion of said longitudinal aperture of said body member of said wrench means adjacent said first end of said body member for selectively coacting therewith and includes a second alignment member having a cross-sectional shape substantially identical to the cross-sectional shape of the portion of said longitudinal aperture of said body member of said wrench means adjacent said second end of said body member for selectively coacting therewith.

5. The tool means of claim 1 in which said first end of said rod member of said securing means includes a tapered portion having a substantially square cross-sectional shape for coacting with a substantially square cross-sectional shaped aperture in a removable valve seat of the water faucet for use in removing the valve seat from the water faucet.

6. The combination with a water faucet of the type having nuts mounted on the water inlet pipes thereof beneath a water basin for holding the water faucet to the water basin, of tool means for removing the nuts from the water inlet pipes, said tool means comprising:

a. wrench means closely fitting around one of said nuts holding the water faucet to the water basin, said wrench means including a body member having a first end and a second end and having a longitudinal aperture completely therethrough, the portion of said longitudinal aperture adjacent said first end of said body member having a cross-sectional shape substantially identical to the cross-sectional shape of a first standard size of said nuts holding the water faucet to the water basin;

b. securring means securing said wrench means to one of said nuts holding the water faucet to the water basin, said securing means including a rod member extending through said longitudinal aperture of said body member of said wrench means and through one of the water inlet pipes of the water faucet and through the water basin and through one of said nuts holding the water faucet to the water basin, said rod member having a first end and a second end, at least said first end of said rod member being threaded, said securing means including a plate member fixedly attached to said second end of said rod member, said plate member being of a shape so as to prevent said wrench means from passing thereover, said securing means including a nut member having a threaded aperture therethrough for coacting with said threaded first end of said rod member in a manner to clamp said wrench means about one of said nuts holding the water faucet to the water basin and against the underneath side of the water basin; and c. means for transmitting torque between said rod member of said securing means and said wrench means.

7. The combination of claim 6 in which the portion of said longitudinal aperture of said body member of said wrench means of said tool means adjacent said second end of said body member has a cross-sectional shape substantially identical to the cross-sectional shape of a second standard size of said nuts holding the water faucet to the water basin.

8. The combination of claim 7 in which said means for transmitting torque between said rod member of said securing means and said wrench means of said tool means includes alignment means fixedly attached to said rod member of said securing means for coacting with said body member of said wrench means to align said longitudinal aperture of said body member of said wrench means about said rod member of said securing means.

9. The combination of claim 8 in which said alignment means of said tool means includes a first alignment member having a cross-sectional shape substantially identical to the cross-sectional shape of the portion of said longitudinal aperture of said body member of said wrench means adjacent said first end of said body member for selectively coacting therewith and includes a second alignment member having a cross-sectional shape substantially identical to the cross-sectional shape of the portion of said longitudinal aperture of said body member of said wrench means adjacent said second end of said body member for selectively coacting therewith.

10. The combination of claim 9 in which said first end of said rod member is provided with a grip portion means for gripping by a wrench or the like for the turning of said rod member and said wrench means to loosen said one of said nuts holding the water faucet to the water basin.

* * * * *